US005701673A

United States Patent [19]

Ullmann et al.

[11] Patent Number: 5,701,673

[45] Date of Patent: Dec. 30, 1997

[54] DRY SHAVING APPARATUS WITH PIVOTALLY MOUNTED LONG-HAIR TRIMMER

[75] Inventors: Roland Ullmann, Offenbach; Helmut Faulstich, Frankfurt, both of Germany

[73] Assignee: Braun Aktiengesellschaft, Kronberg, Germany

[21] Appl. No.: 616,688

[22] Filed: Mar. 15, 1996

[30] Foreign Application Priority Data

Jun. 12, 1995 [DE] Germany ..... 195 21 299.1

[51] Int. Cl.[6] ..... B26B 19/38

[52] U.S. Cl. ..... 30/34.1; 30/43.92

[56] References Cited

U.S. PATENT DOCUMENTS

| | | | |
|---|---|---|---|
| 3,780,434 | 12/1973 | de Boer et al. | 30/34.1 |
| 4,380,869 | 4/1983 | Shirakawa et al. | 30/34.1 |
| 5,052,106 | 10/1991 | Labrijn | 30/34.1 |
| 5,084,967 | 2/1992 | Nakagawa et al. | 30/34.1 |
| 5,185,933 | 2/1993 | Messinger | 30/43.92 |

FOREIGN PATENT DOCUMENTS

| | | | |
|---|---|---|---|
| 2641489 | 7/1990 | France | 30/34.1 |
| 2436276 | 2/1976 | Germany | 30/34.1 |
| 3119018 | 5/1982 | Germany . | |
| 3912090 | 8/1990 | Germany . | |
| 0115953 | 9/1979 | Japan | 30/34.1 |
| 404261690 | 9/1992 | Japan | 30/34.1 |

*Primary Examiner*—Maurina I. Rachuba
*Attorney, Agent, or Firm*—Fish & Richardson P.C.

[57] ABSTRACT

A dry shaving apparatus includes a housing, at least one short-hair cutter, a long-hair trimmer that is pivotally-mounted to the housing such that the long-hair trimmer can pivot into and out of an operating position, an electric drive mechanism which during operation drives said short-hair cutter and said long-hair trimmer, a pivotally-mounted lever, a control rod, and a single control switch mechanism which during operation moves the long-hair trimmer into and out of the operating position and turns the electric drive mechanism on and off, the control switch mechanism being coupled to the long-hair trimmer by the pivotally mounted lever and the control rod and having an ON position and a first and second OFF position. The control switch mechanism in the first OFF position deactivates the long-hair trimmer and maintains the long hair trimmer in the operating position.

16 Claims, 5 Drawing Sheets

DRY SHAVING APPARATUS WITH PIVOTALLY MOUNTED LONG-HAIR TRIMMER

BACKGROUND OF THE INVENTION

This invention relates to a dry shaving apparatus, with a housing and an electric drive mechanism for at least one short-hair cutter as well as for a pivotally mounted long-hair trimmer, and with a single control switch for moving the pivotal long-hair trimmer into and out of an operating position and for switching the electric drive mechanism, with the control switch being coupled to the long-hair trimmer by means of a pivotally mounted lever and a control rod.

A dry shaving apparatus of the type initially referred to is known from DE 39 12 090 C1. By means of a control switch slidably mounted on the front panel of the housing, the short-hair cutter is activated in a first position of the switch. A further position of the switch involves a swinging motion of the pivotally mounted long-hair trimmer into an operating position as well as its activation. Cleaning the long-hair trimmer using, for example, a brush is not possible in this operating position, because the bristles or hairs of the brush would be cut off by the oscillating blade of the long-hair trimmer.

From DE 31 19 018 A1 a dry shaving apparatus is known having a control switch for switching the electric drive mechanism for both the short-hair cutter and the long-hair trimmer, in which the control switch, in a third position, causes the pivotally mounted long-hair trimmer to swing into an operating position, activating it at the same time. For cleaning purposes, the dry shaving apparatus is provided with an additional switch and further components in order to swing the long-hair trimmer into a cleaning position with the control switch being in a position which is not the operating position.

SUMMARY OF THE INVENTION

It is an object of the present invention to simplify the manipulation of a dry shaving apparatus of the type initially referred to such as to ensure use of the cutters provided including a cleaning operation of the long-hair trimmer in an operating position.

According too the present invention, this object is accomplished by the features described below.

It is an essential advantage of the present invention to provide in a dry shaving apparatus having a pivotally mounted long-hair trimmer only a single control switch for performing a plurality of switching functions, such as the activation and de-activation of the electric drive mechanism for the short-hair cutter and the long-hair trimmer, the movement of the pivotally mounted long-hair trimmer into and out of an operating position, and, in addition, the deactivation of at least the cutter portion of the long-hair trimmer by the control switch in order to ensure a thorough cleaning action of the complete long-hair trimmer in its swung-open position. This feature of the invention is of advantage in particular to long-hair trimmers which in the off state of the shaving apparatus are embedded within a recess as, for example, in one of the housing panels of the dry shaving apparatus or a shaving head frame.

In a preferred embodiment of the present invention, a position AUS (OFF) is provided at either end of the opposite directions of movement of the control switch. This feature facilitates operation of the dry shaving apparatus by the user significantly, because all of the functions provided can be set automatically merely by moving the control switch in a direction of movement and in opposition thereto.

In an embodiment of the present invention, the electric drive mechanism is adapted to be deactivated by operation of the control switch while maintaining the operating position EIN (ON) of the long-hair trimmer.

Preferably, the lever is pivotally mounted on the housing. In a further feature of this embodiment, two control cams are provided on the lever. In a still further feature of this embodiment, the control switch and the control rod include each a respective cutout for engagement of the control cams. The cutout in the control switch is configured as a cam path. In a preferred embodiment of the present invention, the cam path is formed of a combination of two elongate cutouts extending in the same direction, yet in an offset relation to each other, and a sloping cutout connecting these cutouts. The cutout in the control rod extends longitudinally in a direction transverse to the direction of movement of the control rod. The cam path formed of the three cutouts advantageously fulfills a variety of functions. The action of the sloping cutout providing the cam path in the control switch upon the control cam ensures a pivotal motion of the lever, while the control cam engaging within the cutout ensures a linear motion of the control rod, and the coupling of the control rod with the long-hair trimmer ensures a pivotal motion of the long-hair trimmer. In addition, by means of the two cutouts extending in the control switch in the same direction and providing the cam path, freedom of motion of the control switch relative to the control rod is ensured.

In another feature of the present invention, the long-hair trimmer and the control switch are adapted to be locked in the positions selectable by the cam path of the control switch, preferably the positions AUS (OFF), EIN (ON), EIN (ON), AUS (OFF), by rigid as well as resilient detent means. Preferably, the rigid detent means are provided on the housing, while the elastic detent means are provided on the control rod and on the control switch. Low-cost manufacture of the detent means is realized by configuring the rigid detent means as locking pins integrally formed on the housing, while the elastic detent means are formed of at least one resilient arm having cams integrally formed thereon. For control of the electric drive mechanism by means of the control switch, resilient elements are arranged on the control switch for making and breaking contact with the conducting strips of the circuit of the electric drive mechanism.

An embodiment of the invention is described subsequently and illustrated in the accompanying drawings.

DESCRIPTION OF PREFERRED EMBODIMENTS

Figure 1:
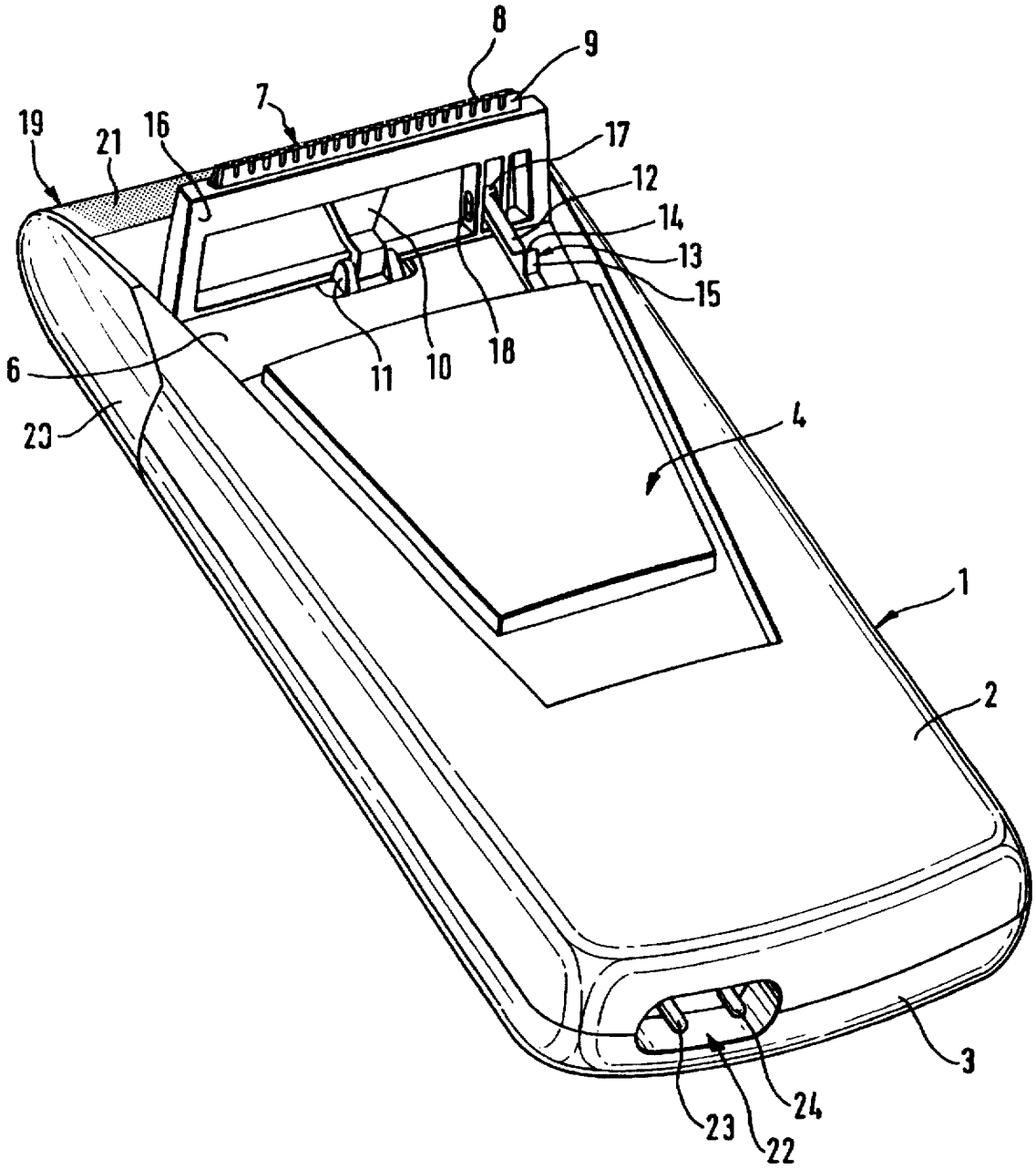
FIG. 1 is a perspective view of a dry shaving apparatus having a long-hair trimmer pivoted into the operating position and coupled to a control switch by means of a control rod.

FIG. 1 shows a dry shaving apparatus with a housing 1 comprising a first housing portion 2 configured in the shape of a shell and a second housing portion 3 configured in the shape of a shell, and with a control switch 4 slidably mounted on the front panel of the first housing portion 2 for activating and deactivating an electric drive mechanism 5 provided in the housing 1 as well as for moving a pivotally mounted long-hair trimmer 7 into and out of a recess 6 provided in the housing portion 2 into an operating position P in which a movable blade 9 operatively associated with a stationary comb 8 is coupled to a bifurcated drive means 11 through a drive lever 10 in order to transmit the oscillatory motion generated by the electric drive mechanism 5 to the movable blade 9. The control switch 4 is coupled to the long-hair trimmer housing 16 by means of a control rod 12 having formed thereon a cam 13 with sloping surfaces 14 and 15, coupling being effected by sliding cams 17 slidably engaging within elongate cutouts 18 provided in the long-hair trimmer housing 16.

Adjacent to the long-hair trimmer 7, a shaving head frame 20 provided with a shaving foil 21 of a short-hair cutter 19 is detachably arranged on the upper end of the housing 1. Provided at the end of the housing 1 remote from the short-hair cutter 19 is an appliance plug 22 having plug pins 23 and 24.

Figure 2:
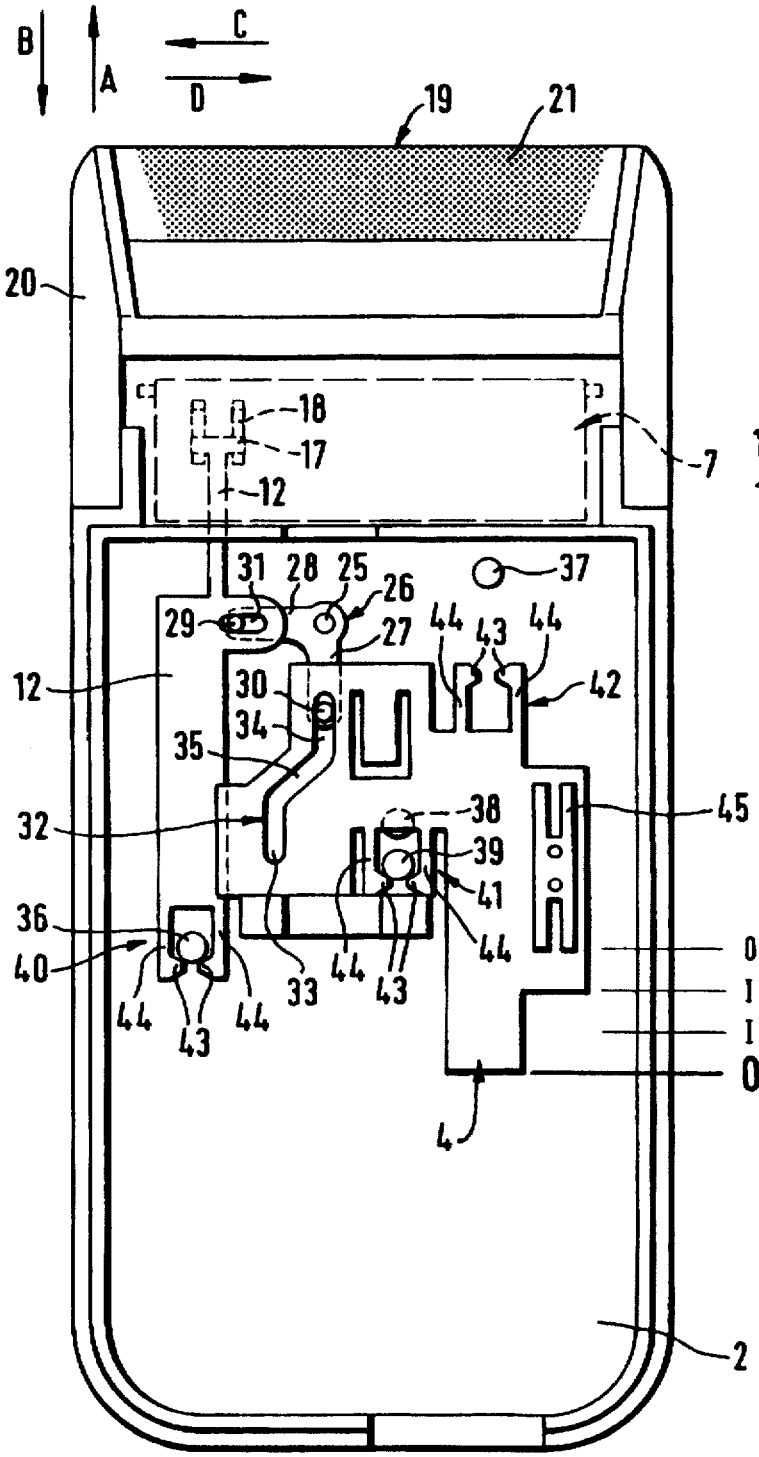
FIG. 2 is a view of an opened dry shaving apparatus having a shell-type housing portion with a control switch and a control rod for the long-hair trimmer.

FIG. 2 shows an interior view of the shell-type housing portion 2 as seen when looking at the rear side of the control switch 4, the control rod 12 and a bearing pin 25 integrally formed on the housing portion 2 for receiving a pivotally mounted double-armed lever 26 having at the ends of its lever arms 27, 28 a respective control cam 29, 30. The control cam 29 is in engagement with an elongate cutout 31 provided in the control rod 12, and the control cam 30 is in engagement with a cutout 32 provided in the control switch 4 and configured as a cam path.

The cutout 32, that is, the cam path in the control switch 4, is comprised of a combination of two elongate cutouts 33, 34 extending in the same direction, yet in an offset relation to each other—direction of arrow A—, and a sloping cutout 35 connecting the cutouts 33 and 34.

Figure 2A:
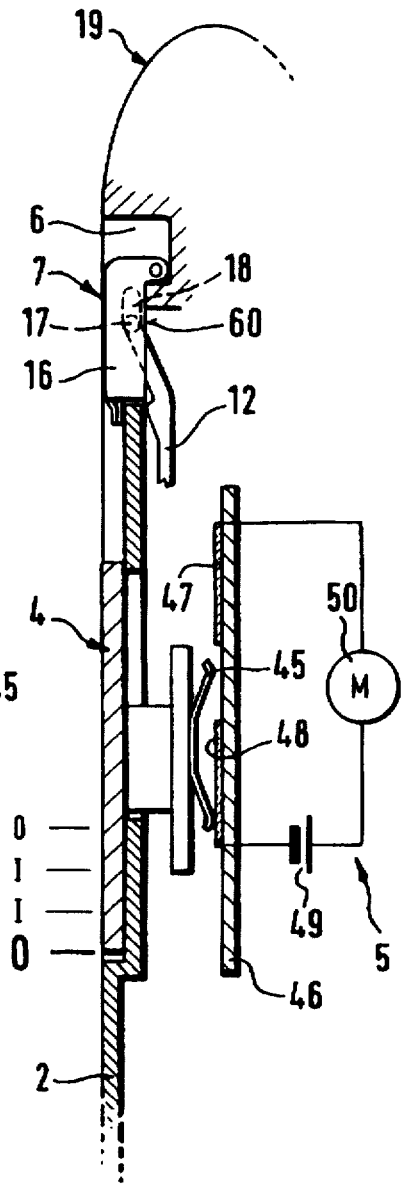
FIG. 2*a* is a sectional view of the housing shell and the control switch of FIG. 2, showing a pivotally mounted long-hair trimmer embedded flush with the housing shell.
Figure 3:
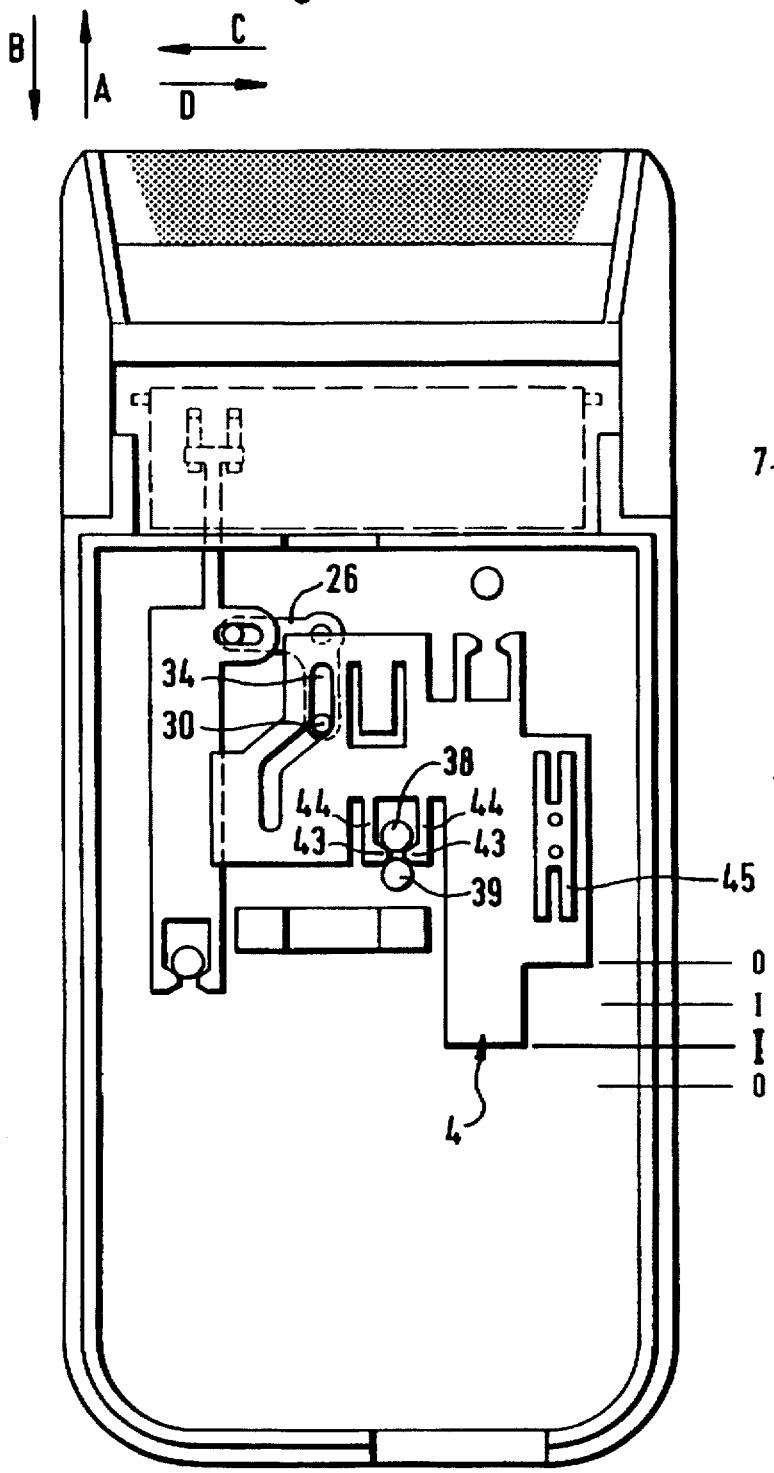
FIG. 3 is a view of the dry shaving apparatus of FIG. 2, showing a control switch in a first position EIN (ON)
Figure 3A:
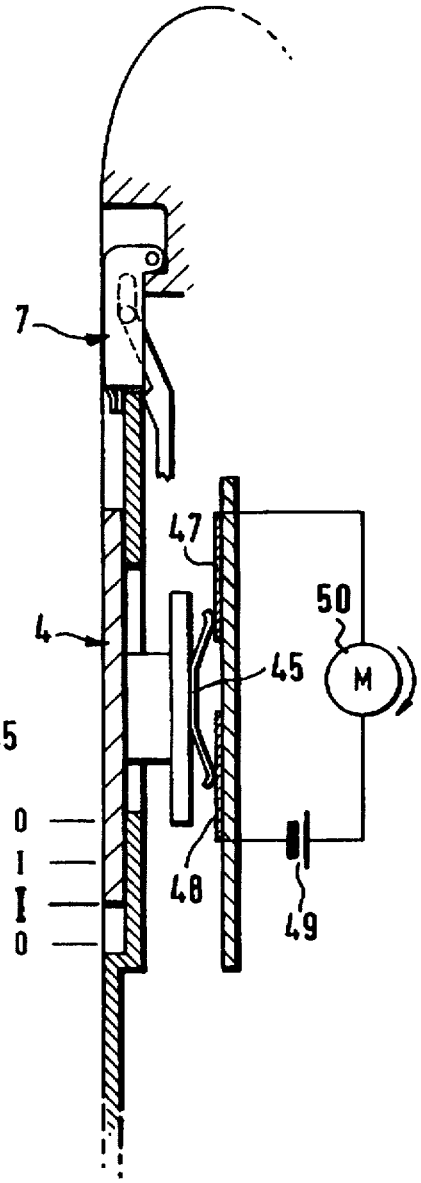
FIG. 3*a* is a sectional view of the dry shaving apparatus of FIG. 3, showing the conducting strips of the electric drive mechanism and the control switch in a first position EIN (ON)

Provided on the inside of the housing portion 2 are a plurality of detent means 36, 37, 38, 39 that cooperate with detent means 40, 41, 42 provided on the control rod 12 and on the control switch 4. The detent means 36, 37, 38, 39, for example, are comprised of locking pins integrally formed on the housing portion 2, while the detent means 40, 41, 42 are resilient arms 44 on which cams 43 are provided. Secured to the control switch 4 is a resilient element 45 that is made of an electrically conductive material. The resilient element 45 serves the function of opening and closing an electric circuit (see FIG. 2*a*). For this purpose, two conducting strips 47, 48 are provided on a component 46. Conducting strip 48, for example, is connected to a terminal of a voltage source 49 as, for example, a battery or a rechargeable accumulator, whilst the other conducting strip 47 is connected to an electric drive motor 50 and connected, via a further conductor, to another terminal of the voltage source 49. In FIGS. 2 and 2*a*, the control switch 4 is shown in a first position AUS (OFF). In consequence, the circuit of the electric drive mechanism 5 is open, that is, the resilient element 45 is in abutting engagement with the conducting strip 48 only. The resilient arms 44 provided on the control rod 12 embrace with their cams 43 the detent means 36, thus locking the control rod 12 in the position AUS (OFF) of the control switch 4. The control switch 4 itself is locked on the detent means 39 in the first position AUS (OFF) equally by means of resilient arms 44 and cams 43 integrally formed thereon. In the closed position, the pivotally mounted long-hair trimmer 7 rests against the outer wall 60 of the recess 6 formed in the front panel of the housing 1. The control cam 29 of the lever 26 is at the end of the elongate cutout 31 situated in the direction of arrow C. In the position AUS (OFF), the control cam 30 of the lever 26 is at the end of the cutout 34 forming the cam path, which end is situated in the direction of arrow A.

FIGS. 3, 3*a*, 4, 4*a*, 5 and 5*a* illustrating the positions of the control switch 4, the control rod 12 and the pivotally mounted long-hair trimmer 7, they will be explained in more detail in the following with reference to these illustrations. By shifting the control switch 4 into the first position EIN (ON), the resilient element 45 makes contact with the two conducting strips 47 and 48, thus closing the electric circuit and thereby driving the drive motor 50 of the electric drive mechanism—see FIG. 3*a*—and transmitting this motion, via further drive means not shown, to the inner cutters of the long-hair trimmer 7 and the short-hair cutter 19. The first position EIN (ON) of the control switch 4 is located by the resilient arms 44 integrally formed on the control switch 4, as well as by the cams 43 provided thereon which, as a result of the shifting motion of the control switch 4 into the first position EIN (ON), are in abutting engagement with the two rigid detent means 38 and 39 and secured by these detent means against an inadvertent displacement in the directions of arrows A and B. As a result of the shifting motion of the control switch 4 in the direction of arrow A, the control cam 30 is at the end of the elongate cutout 34, which end is situated in the direction of arrow B, with the free motion performed by the control switch 4 having released no lever motion of the right-angled double-armed lever 26. Accordingly, in FIG. 3 and FIG. 3*a* the control rod 12 and thus also the pivotally mounted long-hair trimmer 7 are maintained unchanged in their positions illustrated in FIGS. 2 and 2*a* in which use of the long-hair trimmer 7 is not possible for lack of movement into an operating position P. In this position, only the short-hair cutter 19 can be utilized.

Figure 4:
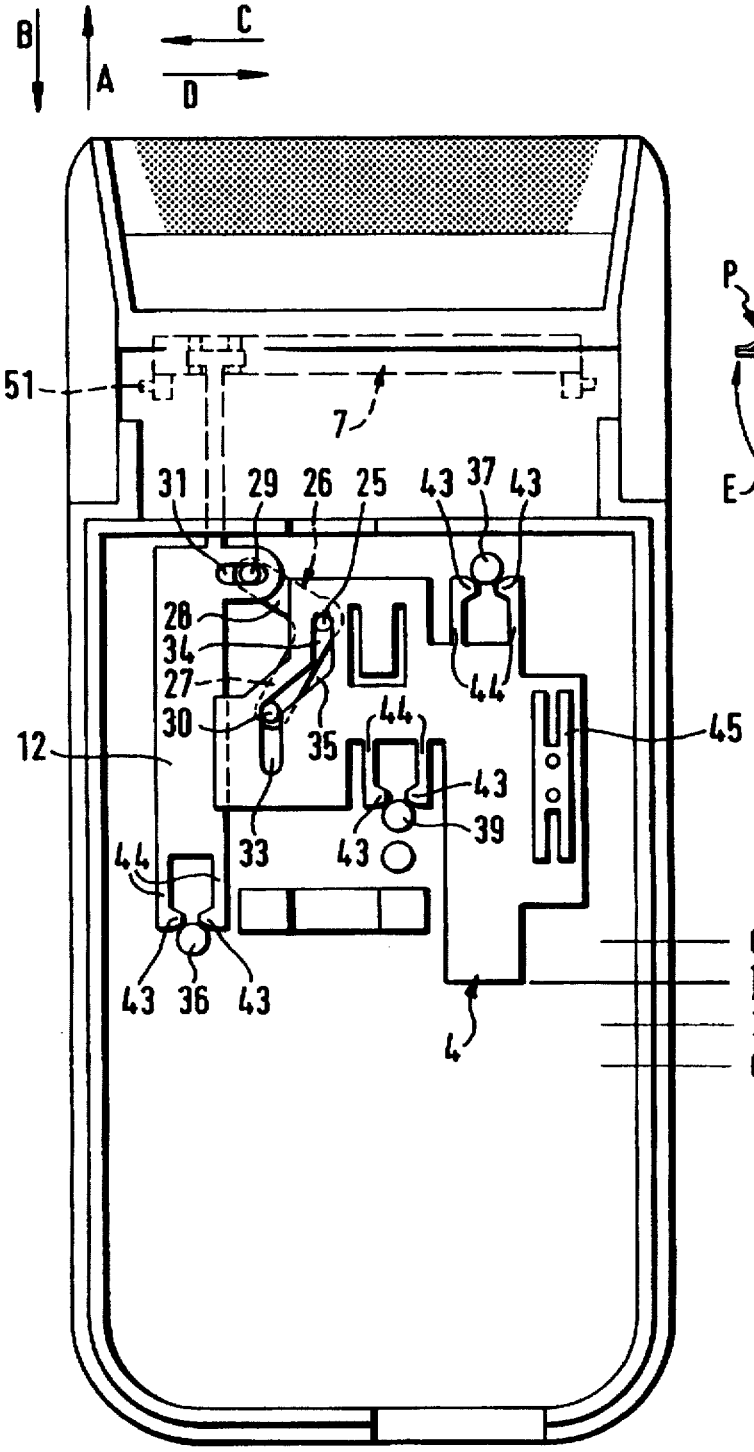
FIG. 4 is a view of the dry shaving apparatus of FIG. 2, showing a control switch in a further position EIN (ON)
Figure 4A:
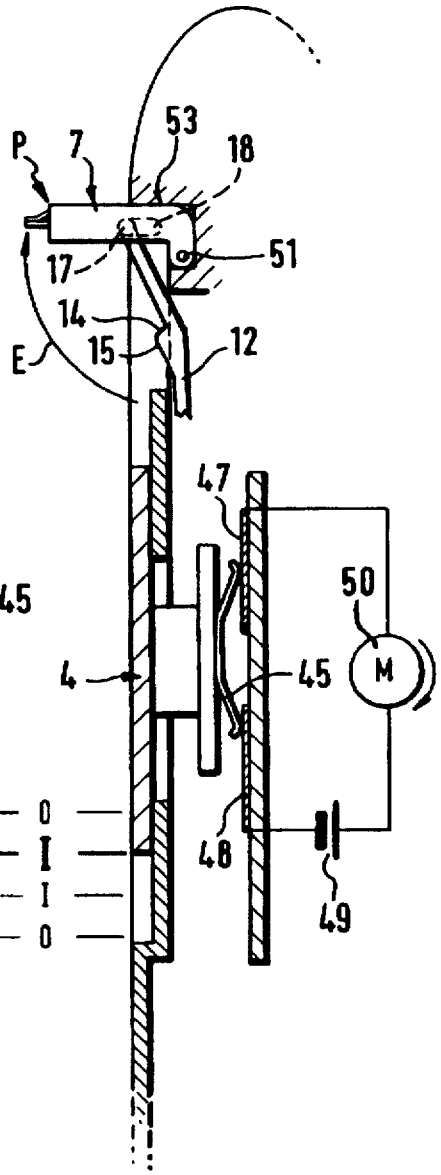
FIG. 4*a* is a sectional view of the dry shaving apparatus of FIG. 2, showing the conducting strips of the electric drive mechanism and the control switch in a second position EIN (ON), and a long-hair trimmer pivoted into an operating position.

In the course of the shifting motion of the control switch 4 into the second position EIN (ON)—see FIG. 4 and FIG. 4*a*—, the electrically conducting resilient element 45 slides along the conducting strips 47 and 48, maintaining the circuit of the electric drive motor 50 closed, whereby the cutters provided, as the long-hair trimmer 7 now activated and the short-hair cutter 19, are in operation. As this shifting motion of the control switch 4 proceeds in the direction of arrow A, the cams 43 of the resilient arms 44 of the control switch 4 slide over the detent means 39, while yet remaining in abutting engagement with the detent means 39 due to the engagement of the cams 43 of the resilient arms 44 of the control switch 4 with the detent means 37. The second position EIN (ON) is thus located by the rigid detent means 37 and 39 in combination with their abutting engagement with the resilient detent means 41 and 42.

In the course of the shifting motion of the control switch 4 in the direction of arrow A—see FIG. 4—, the sloping cutout 35 forming the cam path acts on the control cam 30 provided on the double-armed lever 26 such that the lever 26 performs a swinging motion in the direction of arrow E about the bearing pin 25, until the control cam 30 reaches the transition area between the sloping cutout 35 and the elongate cutout 33 extending vertically in the direction of arrow B. As a result of this swinging motion of the lever arm 27 of the lever 26 in the direction of arrow E, the lever arm 28 of the lever 26 performs equally a swinging motion in the direction of arrow E. As this occurs, the control cam 29 provided on the lever arm 28 acts on the control rod 12 through the elongate cutout 31 extending horizontally in the direction of arrow C or D, effecting a vertical displacement of the control rod 12 in the direction of arrow A. During this vertical movement of the control rod 12, the cams 43 of the detent means 40 of the control rod 12 provided on the resilient arms 44 slide over the detent means 36 without relinquishing the engagement position of the cams 43 with this particular detent means 36. The control rod 12 coupled to the long-hair trimmer housing 16 in the elongate cutout 18 through sliding cams 17 effects a swinging movement of the long-hair trimmer housing 16 about its pivot axis 51, thus bringing the long-hair trimmer 7 into an operating position P suitable for the trimming of long hair as illustrated, for example, in FIG. 4*a*.

Figure 5:
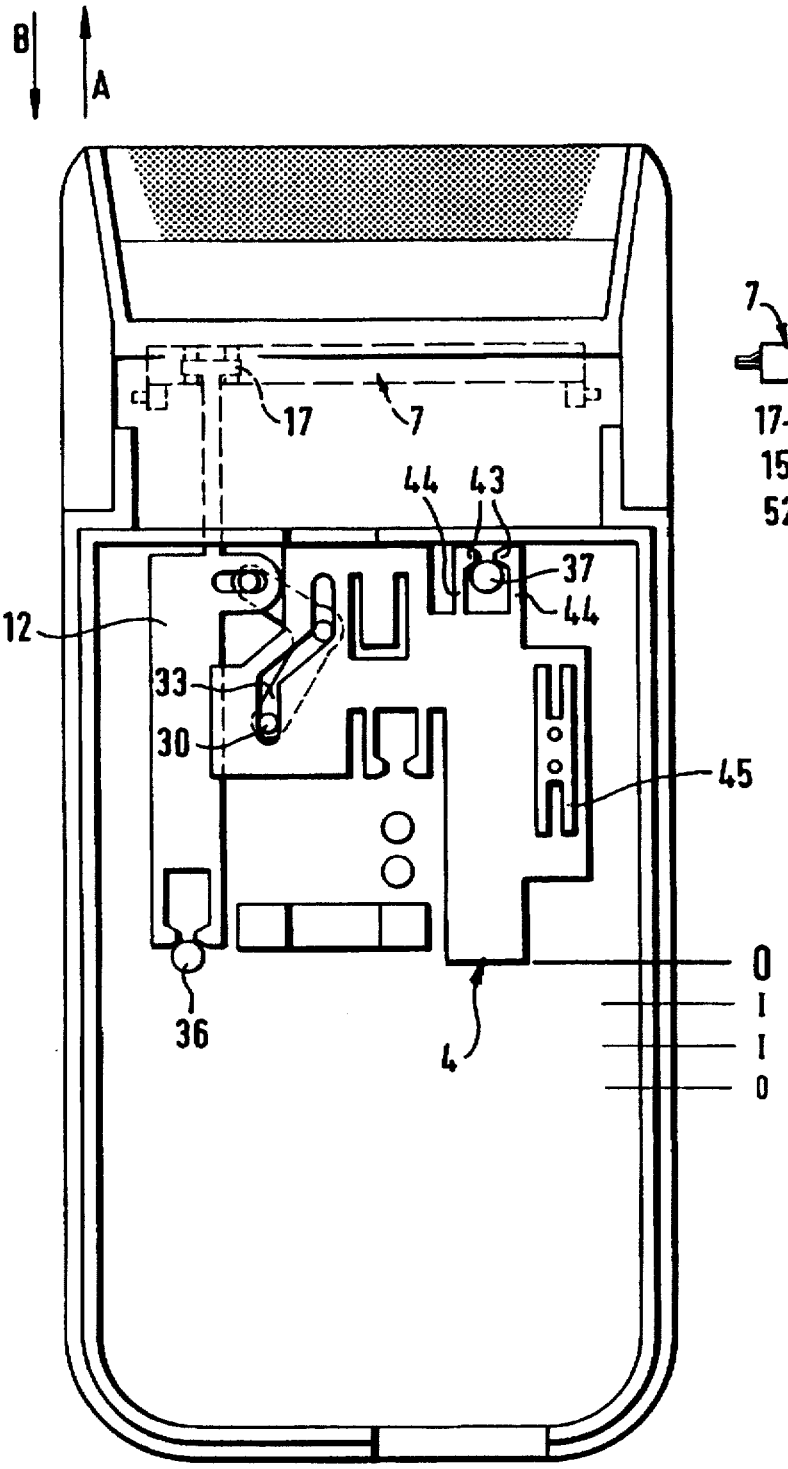
FIG. 5 is a view of the dry shaving apparatus of FIG. 2, showing a control switch in a second position AUS (OFF)
Figure 5A:
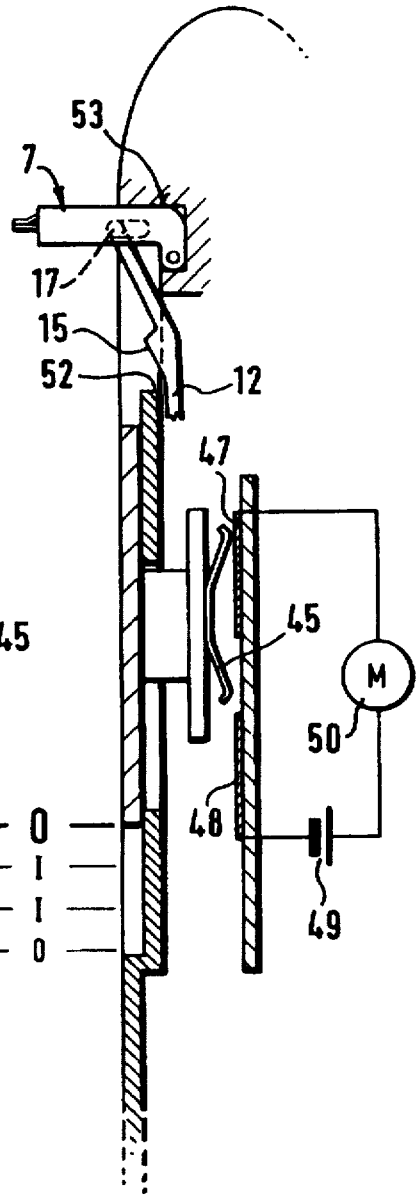
FIG. 5*a* is a view of the dry shaving apparatus of FIG. 2, showing a control switch in a second position AUS (OFF).

The elongate cutout 33 forming the cam path and extending vertically in the direction of arrow A or B ensures, on further displacement of the control switch 4 in the direction of arrow A into a subsequent position, freedom of motion of the control switch 4 relative to the control rod 12—see FIG. 5. As a result, the double-armed lever 26 and the control rod 12 perform no further movement in the directions of arrows A and E on displacement from the second position EIN (ON) into the subsequent position referred to as AUS (OFF). The positions of the lever 26, the control rod 12 and thus of the long-hair trimmer 7 illustrated in FIG. 4 are thus maintained unchanged. The control switch 4 is held in this second position AUS (OFF) by the long-hair trimmer 7 occupying the operating position P and resting against a stop 53, by the cams 43 of the resilient detent means 42 engaging the detent means 37, and, moreover, by the cams 43 of the resilient detent means 40 engaging the rigid detent means 36. In this second position AUS (OFF) which is achievable by the freedom of motion of the control cam 30 within the elongate cutout 33 forming the cam path of the control switch 4 without involving a variation of the operating position P of the long-hair trimmer 7, the conductive resilient element 45 is in abutting engagement with only the conducting strip 47, whereby the electric circuit between the voltage source 49 and the drive motor 50 of the electric drive mechanism 5 is interrupted, thus deactivating both the short-hair cutter 19 and the long-hair trimmer 7. In this second position AUS (OFF), it is possible to clean the long-hair trimmer 7 occupying the operating position P, without, however, being driven, and corresponding parts of the housing 1, in particular the recess 6. On completion of the cleaning operation, the control switch 4 is caused to travel from the second position AUS (OFF) to the first position AUS (OFF) in the direction of arrow B, overriding the two positions EIN (ON), with the sequence of motions previously described being thus reversed. In the process, the long-hair trimmer 7 swung open when in the operating position P is caused to swing back into the recess 6 in the housing 1 by the sliding cams 17 of the control rod 12 in opposition to the direction of arrow E, this swinging motion being ensured by the sloping surface 15 provided on the control rod 12 in cooperation with an edge 52 on the housing. Upon reaching the first position AUS (OFF), the control switch 4, the pivotally mounted long-hair trimmer 7, the lever 26 and the resilient element 45 occupy the positions illustrated in FIGS. 2 and 2*a*. The dry shaving apparatus is again in a deactivated position.

We claim:

1. A dry shaving apparatus comprising:

a housing;

at least one short-hair cutter;

a long-hair trimmer that is pivotally-mounted to the housing such that the long-hair trimmer can pivot into and out of an operating position;

an electric drive mechanism which during operation drives said short-hair cutter and said long-hair trimmer;

a pivotally-mounted lever;

a control rod; and a single control switch which during operation moves the long-hair trimmer into and out of the operating position and turns the electric drive mechanism on and off, said control switch being coupled to the long-hair trimmer by the pivotally mounted lever and the control rod and having an ON position and a first and second OFF position, wherein the control switch in the first OFF position deactivates the long-hair trimmer and maintains the long hair trimmer in the operating position.

2. The dry shaving apparatus as claimed in claim 1 wherein the positions of the control switch lie substantially along a line segment with the first OFF position lying at one end of the line segment and the second OFF position lying at the other end of the line segment.

3. The dry shaving apparatus as claimed in claim 1 wherein the control switch in the first OFF position deactivates the electric drive mechanism and maintains the long-hair trimmer in the operating position.

4. The dry shaving apparatus as claimed in claim 1 wherein the lever is pivotally mounted on the housing.

5. The dry shaving apparatus as claimed in claim 4 wherein the lever includes a first control cam and a second control cam.

6. The dry shaving apparatus as claimed in claim 5 wherein the control switch includes a first cutout for engagement of the first control cam and the control rod includes a second cutout for engagement of the second control cam.

7. The dry shaving apparatus as claimed in claim 6 wherein the first cutout is configured as a cam path.

8. The dry shaving apparatus as claimed in claim 7 wherein the cam path is formed by a combination of two elongate cutouts that are substantially parallel and a sloping cutout connecting the elongate cutouts.

9. The dry shaving apparatus as claimed in claim 8 wherein the second cutout extends longitudinally in a direction transverse to the direction of movement of the control rod.

10. The dry shaving apparatus as claimed in claim 8 wherein the action of the sloping cutout upon the second control cam ensures a pivotal motion of the lever, the second control cam engaging within the second cutout ensures a linear motion of the control rod, and the coupling of the control rod with the long-hair trimmer ensures a pivotal motion of the long-hair trimmer.

11. The dry shaving apparatus as claimed in claim 8 wherein freedom of motion of the control switch relative to the control rod is ensured by the elongate cutouts in the control switch extending in the same direction as the control rod.

12. The dry shaving apparatus as claimed in claim 7 further comprising rigid and resilient detents which lock the long-hair trimmer and the control switch in the positions selectable by the cam path.

13. The dry shaving apparatus as claimed in claim 12 wherein the rigid detents are provided on the housing and the resilient detents are provided on the control rod and on the control switch.

14. The dry shaving apparatus as claimed in claim 12 wherein the rigid detents are configured as locking pins integrally formed on the housing.

15. The dry shaving apparatus as claimed in claim 12 wherein the resilient detents are formed of at least one resilient arm having cams integrally formed thereon.

16. The dry shaving apparatus as claimed in claim 1 wherein a resilient element is arranged on the control switch for making and breaking contact with conducting strips of a circuit of the electric drive mechanism.

* * * * *